US008609989B2

(12) United States Patent
Huber

(10) Patent No.: US 8,609,989 B2
(45) Date of Patent: Dec. 17, 2013

(54) ELECTRICAL CABLE AND METHOD AND DEVICE FOR THE MANUFACTURE THEREOF

(75) Inventor: Martin Huber, Obing (DE)

(73) Assignee: MD Elektronik GmbH, Waldkraiburg (DE)

( * ) Notice: Subject to any disclaimer, the term of this patent is extended or adjusted under 35 U.S.C. 154(b) by 210 days.

(21) Appl. No.: 12/990,286

(22) PCT Filed: Mar. 26, 2009

(86) PCT No.: PCT/EP2009/002197

§ 371 (c)(1),
(2), (4) Date: Jan. 5, 2011

(87) PCT Pub. No.: WO2009/132735

PCT Pub. Date: Nov. 5, 2009

(65) Prior Publication Data

US 2011/0100672 A1 May 5, 2011

(30) Foreign Application Priority Data

Apr. 30, 2008 (DE) ..... 10 2008 021 747

(51) Int. Cl.
*H01B 7/18* (2006.01)

(52) U.S. Cl.
USPC ..... 174/102 R

(58) Field of Classification Search
USPC ..... 174/74 R, 74 A, 75 B, 76, 77 R, 78, 36
See application file for complete search history.

(56) References Cited

U.S. PATENT DOCUMENTS

| | | | | |
|---|---|---|---|---|
| 3,541,495 | A | 11/1970 | Ellis et al. | |
| 5,763,825 | A * | 6/1998 | Gilliland | 174/36 |
| 6,218,619 | B1 | 4/2001 | Asakura et al. | |
| 7,173,182 | B2 * | 2/2007 | Katsuyama et al. | 174/36 |
| 2001/0020540 | A1 | 9/2001 | Sakaguchi et al. | |
| 2002/0142653 | A1 | 10/2002 | Hosaka et al. | |
| 2005/0133245 | A1 | 6/2005 | Katsuyama et al. | |
| 2008/0318476 | A1 | 12/2008 | Weber et al. | |

FOREIGN PATENT DOCUMENTS

| | | | |
|---|---|---|---|
| EP | 0 694 989 | A2 | 1/1996 |
| EP | 1246300 | A * | 3/2002 |
| EP | 1 246 300 | A2 | 10/2002 |
| GB | 2 328 805 | A | 3/1999 |
| WO | WO 2006/008022 | A1 | 1/2006 |

* cited by examiner

*Primary Examiner* — William H Mayo, III
(74) *Attorney, Agent, or Firm* — Brinks Gilson & Lione

(57) ABSTRACT

An electrical cable including an inner conductor arrangement having a longitudinally extended conductor. The electrical cable further including an outer sheath that surrounds the inner conductor arrangement annularly in cross-section, and an electrical shield that extends between the inner conductor arrangement and the outer sheath, wherein a portion of the electrical shield is turned inside out in such a way that it is spaced apart from a main area of the electrical shield. The portion defines an inside-out portion and extends between the inner conductor arrangement and the outer sheath transversely to a direction in which the electrical cable extends. In addition, an exterior region of the inside-out portion of the electrical shield is incorporated in at least some portions into the sheath of the electrical cable.

6 Claims, 4 Drawing Sheets

ELECTRICAL CABLE AND METHOD AND DEVICE FOR THE MANUFACTURE THEREOF

Applicant claims, under 35 U.S.C. §§120 and 365, the benefit of priority of the filing date of Mar. 26, 2009 of a Patent Cooperation Treaty patent application, copy attached, Serial Number PCT/EP2009/002197, filed on the aforementioned date, the entire contents of which are incorporated herein by reference, wherein Patent Cooperation Treaty patent application Serial Number PCT/EP2009/002197 was not published under PCT Article 21(2) in English.

Applicant claims, under 35 U.S.C. §119, the benefit of priority of the filing date of Apr. 30, 2008 of a German patent application, copy attached, Serial Number 10 2008 021 747.6, filed on the aforementioned date, the entire contents of which is incorporated herein by reference.

BACKGROUND OF THE INVENTION

1. Field of the Invention

The present invention relates to an electrical cable and to a method and a device for the manufacture of an electrical cable.

2. Description of the Related Art

An electrical cable of this kind includes an inner conductor arrangement, having one or more longitudinally extending electrical conductors as well as an (insulating) outer sheath, which surrounds the inner conductor arrangement, and an electrical shield of the cable. The electrical shield surrounds the conductor arrangement annularly in cross-section and, viewed in the radial direction—that is, at right angles to the direction in which the inner conductor arrangement extends—extends between the inner conductor arrangement and the outer sheath of the cable. The individual electrical lines of the inner conductor arrangement are advantageously each provided with an electrically insulating jacket, in order to avoid an electrical contact between the individual conductors of the inner conductor arrangement and with the electrical shield of the cable.

In such shielded electrical cables, it is known for the electrical shield to be turned inside out or everted onto an end portion of the cable, on which an electric plug connector is to be provided, for instance, in such a way that an outer portion of the shield extends on the exterior (remote from the inner conductor arrangement) of the outer sheath of the cable, so that in the radial direction it is spaced apart from the main area of the electrical shield extending between the inner conductor arrangement and the outer sheath. The outer sheath of the cable, in the end portion where the electrical shield of the cable is turned inside out, can have a support sleeve, along which part of the inside-out portion of the shield extends. The support sleeve is adjoined in the axial direction, that is, the direction in which the conductor arrangement extends, by a conventional insulating jacket, comprising a soft elastic or flexible material, of the outer sheath of the cable.

For fixing the arrangement on that end portion of the outer sheath of the cable on which the inside-out portion of the electrical shield of the cable extends, a fixation sleeve can be applied, for instance in the form of a crimped sleeve. The fixation sleeve surrounds the outer portion of the electrical shield and holds onto the exterior of the sheath of the cable. An electrical cable of this kind is described for instance in European Patent Disclosure EP 0 694 989 A2.

If the electrical shield of the cable includes a mesh of many individual stranded wires, an undefined setup of individual stranded wires of the shield can occur after the portion of the electrical shield has been turned inside out, so that this portion extends as an outer area of the shield on the exterior (outer surface) of the outer sheath of the cable. The undefined setup makes further processing steps, such as applying an outer fixation sleeve, more difficult and as a consequence can lead to a poor appearance or functional problems. Moreover, from the aspect of workplace safety, there is a risk of injury at stranded wires that are set up in an undefined way in a mesh shield.

SUMMARY AND OBJECTS OF THE INVENTION

An object of the present invention is to create an electrical cable of the type defined at the outset which is distinguished by a defined positioning of an inside-out portion of the electrical shield of the cable. Moreover, a method and a device are to be disclosed for manufacturing an improved electrical cable of this kind.

This object is attained in terms of an electrical cable including an inner conductor arrangement having a longitudinally extended conductor. The electrical cable further including an outer sheath that surrounds the inner conductor arrangement annularly in cross-section, and an electrical shield that extends between the inner conductor arrangement and the outer sheath, wherein a portion of the electrical shield is turned inside out in such a way that it is spaced apart from a main area of the electrical shield. The portion defines an inside-out portion and extends between the inner conductor arrangement and the outer sheath transversely to a direction in which the electrical cable extends. In addition, an exterior region of the inside-out portion of the electrical shield is incorporated in at least some portions into the sheath of the electrical cable.

Accordingly, the inside-out portion of the electrical shield of the cable is incorporated into the outer sheath of the cable in such a way that the inside-out portion of the electrical shield extends in at least some portions in the outer sheath of the electrical cable (but is spaced apart from the inner main area of the electrical shield in the radial direction as much as possible).

As a result, a defined positioning of the inside-out portion of the electrical shield of the cable on the outer sheath of that cable can be attained. In the case of an electrical shield embodied as a mesh there are no individual stranded wires of the shield that protrude outward in an undefined way.

For that purpose, it can be provided in particular that the electrical shield of the cable has been pressed inward, under pressure, into a portion of the outer sheath of the cable that has been melted beforehand by heating. In other words, the outer sheath of the cable, in one portion, is converted by heating into a (viscous) state which permits the inside-out portion of the electrical shield of the cable to be pressed into that portion of the sheath.

If the outer sheath of the cable has not only a jacket that can be converted by heating into a (viscous) molten state but also a support sleeve adjoining the jacket in the axial direction. The support sleeve serves to brace the inside-out portion of the electrical shield. The inside-out portion of the electrical shield extends in the axial direction, or in other words in the direction in which the electrical cable extends, and advantageously extends so far that it extends past that support sleeve as far as the elastic jacket of the outer sheath, into which sheath the outer portion of the electrical shield is preferably to be incorporated.

Toward the exterior, the (end) portion of the electrical cable, which is the portion of the electrical shield that is provided with the inside-out portion and is incorporated into the outer sheath of the cable, can in turn be surrounded by a fixation sleeve, for instance in the form of a crimped sleeve.

A method for manufacture of an electrical conductor with a portion, positioned in a defined way and turned inside out, of the electrical shield is defined by furnishing an inner conductor arrangement, wherein the inner conductor arrangement includes an electrical conductor extending in a longitudinal direction, and which is surrounded by an outer sheath, and an electrical shield extends between the inner conductor arrangement and the outer sheath. The method includes turning a portion of the electrical shield inside out in such a way so as to form an inside-out portion that extends along an exterior, remote from the inner conductor arrangement of the sheath. The method further includes incorporating the inside-out portion of the electrical shield in a portion into the outer sheath of the electrical cable, so that a portion of the inside-out portion extends in a wall formed by the sheath.

Accordingly, it is provided in particular that the inside-out portion of the electrical shield of the cable be incorporated in at least some portions into the outer sheath of the cable, specifically by being pressed in, once the outer sheath of the cable has been put by heating into a (viscous) molten state.

A device for performing the aforementioned method for manufacturing an electrical cable, in which an inside-out portion of the electrical shield is incorporated into the outer sheath of the cable, includes one or more movable tools that in a first position form an opening. An (end) portion of the electrical cable provided with a inside-out portion of the electrical shield can be introduced. After the introduction of the aforementioned (end) portion of the cable into the opening, one or more movable tools are movable into a second position in which the one or more movable tools they press the inside-out portion of the electrical shield of the cable into the outer jacket of the cable.

Concretely, the movable tool or tools, in a first position, can define an opening having a first cross-section. The (end) portion of the cable, provided with the inside-out portion of the electrical shield, can be introduced into the opening. After being moved into the second position, the one or more tools form an opening having a second, smaller cross-section, namely a cross-section which is smaller than the cross-section of the cable, measured as far as the exterior of the outer sheath of the cable, so that as the tool or tools are being moved from the first to the second position, the inside-out portion of the electrical shield is pressed into the outer sheath of the cable.

The second cross-section of the opening should simultaneously be greater than the cross-section of the space enclosed by the inside of the outer sheath of the cable, so that the inside-out portion of the electrical shield of the cable is not pressed as far as the interior of the cable that is surrounded by the outer sheath, but rather extends within that outer sheath.

Advantageously, a heating device is also provided, with which the outer sheath of the cable is heated on that (end) portion and is converted into a (viscous) molten state, in which the inside-out portion of the electrical shield is to be incorporated.

Further details and advantages of the present invention will become clear from the ensuing description of exemplary embodiments in conjunction with the drawings.

BRIEF DESCRIPTION OF THE DRAWINGS

Shown are.

DESCRIPTION OF THE PREFERRED EMBODIMENT(S) OF THE INVENTION

Figure 1:
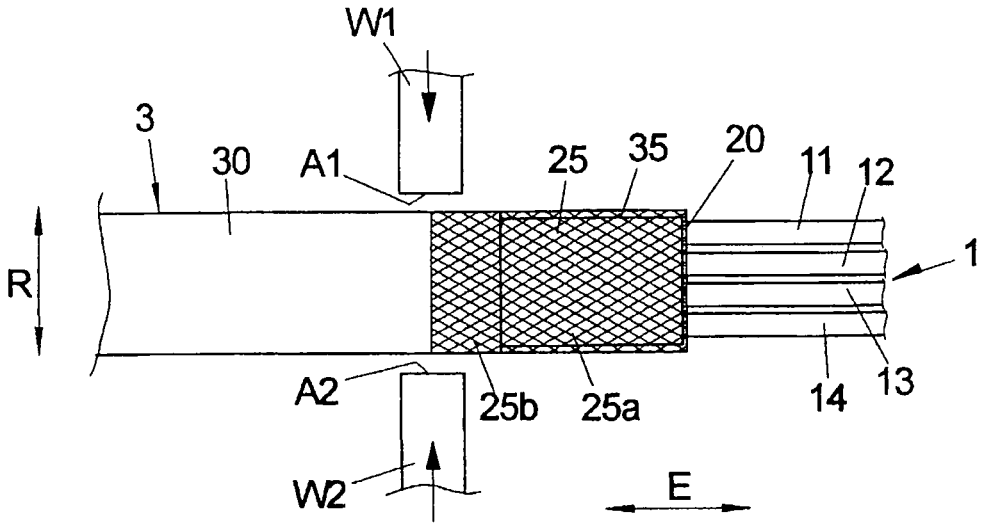
FIG. 1 is a schematic illustration of an embodiment of an electrical cable in accordance with the present invention, wherein the electrical cable includes an inner conductor arrangement, an electrical shield, and an outer sheath, as well as of parts of a tool with which an inside-out portion of the electrical shield of the cable can be incorporated into the outer sheath of the cable.
Figure 1A:
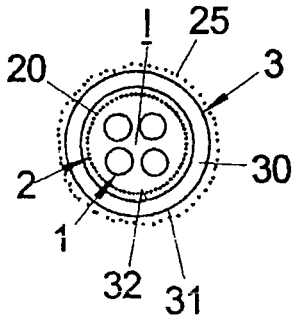
FIG. 1A is a cross-section through the electrical cable of FIG. 1.

FIGS. 1 and 1A schematically show an electrical cable, with an inner conductor arrangement 1 extending longitudinally (in an extension direction E), including a plurality of longitudinally extending electrical conductors 11, 12, 13, 14, which are each provided in a known fashion with an electrically insulating jacket, so that the individual conductors 11, 12, 13, 14 of the conductor arrangement 1 are insulated electrically from one another.

The inner conductor arrangement 1 is surrounded by an electrical shield 2, formed by a mesh shield, including many electrically conductive stranded wires, which (with a main area 20) surrounds the inner conductor arrangement 1 annularly in cross-section. The electrical shield 2 of the cable, or more precisely its main area 20, is adjoined outward by an (insulating) outer sheath 3, which surrounds both the inner conductor arrangement 1 and the electrical shield 2, or its main area 20. Thus, the electrical shield 2 with its main area 20 extends between the inner conductor arrangement 1 and the outer sheath 3 of the cable. Expressed in other words, in the electrical cable, in the radial direction R from inside to outward, a conductor arrangement 1, a main area 20 of an electrical shield 2, and an outer sheath 3 follow one another.

The outer sheath 3 of the cable is formed predominantly by a (soft-) elastic or flexible jacket 30 (for instance comprising PVC or PUR), which is adjoined on an axial end portion of the cable by a dimensionally stable support sleeve 35, which can be attached to the inner conductor arrangement 1 for instance by crimping as a crimped sleeve.

An end portion of the cable, shown on the right in FIG. 1, is to be provided with a plug connector, by way of which the electrical cable can be connected to an associated electrical assembly. For that purpose, the electrical conductors 11, 12, 13, 14 of the inner conductor arrangement 1 (on the far side of the support sleeve 35) are freed there of the outer sheath 3, to enable electrical contacting of the conductors 11, 12, 13, 14 with plug elements, provided for the purpose, of a plug connector.

Also on each end portion of the cable, a portion 25 (end area) of the electrical shield 2 of the cable is turned inside out or everted (by 180°), so that—in contrast to the main area 20 of the electrical shield 2—it no longer extends between the inner conductor arrangement 1 and the outer sheath 3 of the cable, but instead extends on the exterior 31 (remote from the inner conductor arrangement 1) of the outer sheath 3. The portion 25, located on the exterior, of the electrical shield 2 extends with a first portion 25*a* on the exterior of the support sleeve 35 and with an adjoining second portion 25*b* on the exterior 31 of the jacket 30 of the outer sheath 3. In other words, the electrical shield 2 of the cable, which extends with a main area 20 between the inner conductor arrangement 1 and the outer sheath 3 of the cable along the direction E in which it extends, is turned inside out or everted in such a way with its portion 25, forming one end area of the shield 2, on the right end portion of the cable, that that particular portion 25 extends some distance to the rear along the direction E in which the cable extends, specifically extending past the support sleeve 35 of the outer sheath 3. The shield 2 surrounds the inner conductor arrangement 1 annularly in cross-section. Thus this portion 25, located on the exterior, of the electrical shield 2 extends as far as the elastic or flexible insulating jacket 30 of the outer sheath 3.

An outer fixation sleeve, for instance in the form a further crimped sleeve, can be disposed in the usual way above the end portion of the cable that is provided with the outer, inside-out portion 25 of the electrical shield 2.

After the turning inside out or folding over of a portion 25 of the electrical shield 2, to prevent individual stranded wires of the mesh forming the electrical shield 2 are prevented from protruding in an undefined way. In order to accomplish this, it is provided that that particular portion 25 located on the exterior of the electrical shield 2 is to be incorporated in some portions into the outer sheath 3, or more precisely into the elastic or flexible jacket 30 of the sheath 3, in such a way that that portion 25 of the electrical shield 2 extends in some portions inside that jacket 30. In particular, the free ends 25*b* extend inside the jacket 30. Accordingly, the individual stranded wires of the mesh that forms the electrical shield 2 extend in the wall of the jacket 30, as shown schematically in FIG. 1 in a cross-section through the electrical cable.

The inside-out portion 25 located on the exterior of the electrical shield 2, or more precisely, the stranded wires forming the corresponding mesh shield, are incorporated into the jacket 30 of the outer sheath 3. Such incorporation into the jacket 30 is only to such an extent that the portion 25 of the electrical shield 2 does not if at all possible, protrude into the interior I of the cable surrounded by the outer sheath 3, where after all the main area 20 of the electrical shield 2 and the inner conductor arrangement 1 both extend. In other words, the portion 25 incorporated into the jacket 30 of the outer sheath 3 of the electrical shield 2 extends inside the annularly surrounding wall of the jacket 30, but not through it or through its inside 32 as far as the interior I of the cable that is surrounded by precisely that jacket 30. As a result, the portion 25 incorporated into the jacket 30 of the outer sheath 3 of the electrical shield 2 is spaced apart, especially in the radial direction, from the main area 20 located on the inside of the electrical shield 2.

Figure 2A:
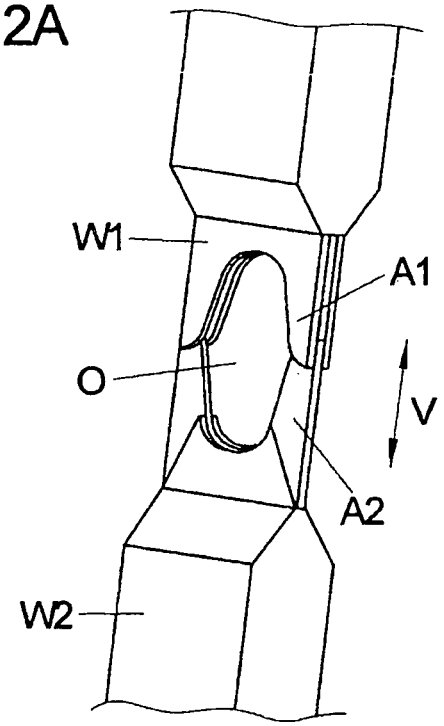
FIG. 2A is an embodiment of a tool to be used with the electrical cable of FIG. 1A wherein the tool is in a first state in which an electrical cable can be introduced into the tool.

As becomes clear from looking at FIGS. 1A and 2A together, the tool with which the inside-out portion 25 of the electrical shield 2 can be incorporated into the outer sheath 3 or into the jacket 30 of the cable, includes two tool parts W1, W2, which are movable relative to one another in a movement direction V (FIG. 2A). Each of the two tool parts W1, W2 on a face end toward the respective other tool part W2, W1 has a receptacle A1, A2, and the two receptacles A1, A2 together form an opening O for the electrical cable to be processed.

In the first state shown in FIG. 2A, the two tool parts W1, W2 assume a first relative position to one another in the movement direction V. In the first state, the opening O formed by the two receptacle areas A1, A2 has such a large cross-section that the electrical cable can be introduced into it until its end portion, provided with the inside-out portion 25 of the electrical shield 2, is located in that opening O between the receptacle areas A1, A2 of the two tools W1, W2. In other words, the cross-section of the opening O in the first state of the tool, in which the receptacle areas A1, A2 of the two tools W1, W2 have a first relative position to one another along the movement axis V, is greater than the end portion of the electrical cable provided with the inside-out portion 25 of the electrical shield 2; see particularly FIG. 1A.

After the end portion of the cable, provided with the inside-out portion 25 of the electrical shield 2, has been disposed in the opening O between the two tool parts W1, W2, these tool parts are moved toward one another in the movement direction V, which coincides with the radial direction R of the electrical cable to be processed. The cross-section of the opening O formed between the two receptacle areas A1, A2 decreases in the process; see FIG. 2B. First, the receptacle areas A1, A2, formed by shaping jaws of the tool parts W1, W2, collect the shield stranded wires on the free end 25*b* of the electrical shield 2 and position them parallel to the exterior 31 of the jacket 30. As the tool parts W1, W2 move even closer together, the portion 25 of the electrical shield 2 that extends on the exterior 31 of the outer sheath 3 or of the jacket 30, is then incorporated into the sheath 3, or more precisely, the jacket 30.

However, this incorporation into the jacket 30 is effected not solely under the pressure of the tool parts W1, W2 moving toward one another, but also with shifting of the portion of the jacket 30, covered by the inside-out portion 25 of the electrical shield 2, to a molten state, in which the receptacle areas A1, A2 of the tool parts W1, W2 are correspondingly heated. For that purpose, suitable heating wires or other heating processes/devices, which can be operated electrically, for instance, can be provided at the receptacle areas A1, A2.

Once the inside-out portion 25 of the electrical shield 2, or more precisely its free end 25*b* covering the jacket 30 of the outer sheath 3, has been pressed into the jacket by the movement closer together of the tool parts W1, W2 into the second relative position, shown in FIG. 2B, with simultaneous heating of the jacket 30, the jacket 30 is subsequently cooled down again. In addition, the tool is opened again; that is, the tool parts W1, W2 are converted back to the first state, shown in FIG. 2A. In this state, the two tool parts W1, W2 are spaced apart from one another such that the electrical cable can easily be removed from the tool.

Figure 1B:
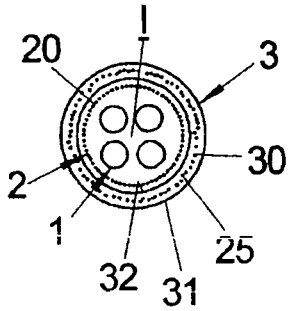
FIG. 1B is a cross-section through the electrical cable of FIG. 1A after the inside-out portion of the electrical shield of the cable has been incorporated into the outer sheath of the cable.

In the cross-section in that area of its jacket 30 that had been covered by the inside-out portion 25 of the electrical shield 2, the cable now has the configuration shown in FIG. 1B. That is, in this portion of the jacket 30, the individual stranded wires of the mesh, which form the free end 25*b* of the electrical shield 2, extend inside the wall formed by that jacket 30.

Figure 2B:
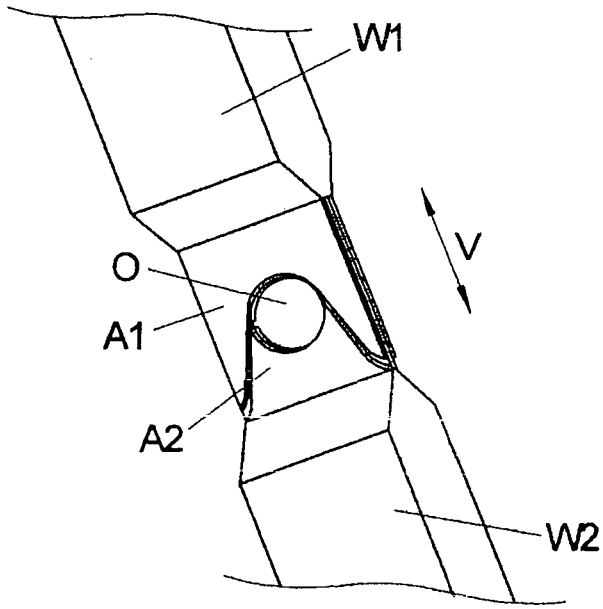
FIG. 2B is the tool of FIG. 1A in a second state, in which an inside-out portion of the electrical shield of the cable can be incorporated into the outer sheath of the cable.

Concretely, the receptacle areas A1, A2 of the tool parts W1, W2 in the present exemplary embodiment, in their second relative position, as shown in FIG. 2B, form a circular opening O, whose inside diameter is smaller than the exterior diameter of the electrical cable, to be processed, on the exterior 31 of its jacket 30. The opening O is simultaneously greater than the inside diameter of the electrical cable, to be processed, on the inside 32, oriented toward the interior I of the jacket 30. As a result, the individual stranded wires of the free end 25*b* of the electrical shield 2 in FIG. 1B are introduced into the wall of the viscous, molten jacket 30, yet without being transferred into the interior I of the cable.

The precise ratio between the cross-section (inside diameter) of the opening O in the second, closed state of the tool parts W1, W2 and the exterior diameter of the cable on the exterior 31 of its jacket 30 can be ascertained in the particular individual case from the geometric design of the cable and from the materials used. Typical wall thicknesses of the jacket 30 are on the order of magnitude of 1 mm, an example being 0.6 mm.

Preferably, the receptacle areas A1, A2 of the tools W1, W2 can be heated separately from one another, specifically using a (thermally) regulated heating device. The quantity of heat to be introduced, by heating of the receptacle areas A1, A2, into the sheath 3 of the cable to be processed, should be selected such that the material of the jacket 30 becomes molten and as a result advantageously changes into a viscous state. Such viscous state makes it possible to press the free end 25*b* of the electrical shield 2 into the jacket 30 of the cable. For that purpose, besides the temperature, the duration of heating should also be suitably set.

The tool parts W1, W2, with their receptacle areas A1, A2, remain in the closed position shown in FIG. 2B for a sufficiently long dwell time, after the free end 25*b* of the electrical shield 2 has been pressed into the jacket 30 of the cable, to form a defined circular contour on the (molten) exterior 31 of the jacket 30 and to keep the portion 25*b* of the electrical shield 2 that has been pressed into the jacket 30, or its individual stranded wires, inside the jacket 30 until the jacket 30 has cooled down sufficiently.

Figure 3B:
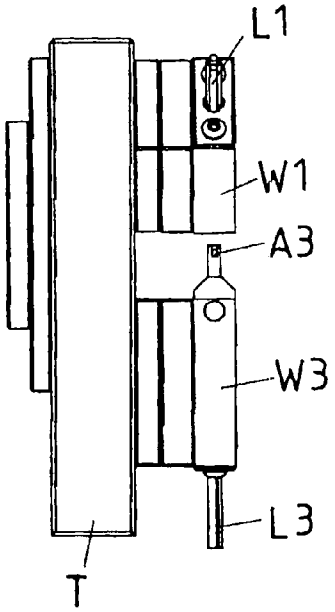
FIG. 3B is the tool of FIG. 3A in a side view.
Figure 3C:
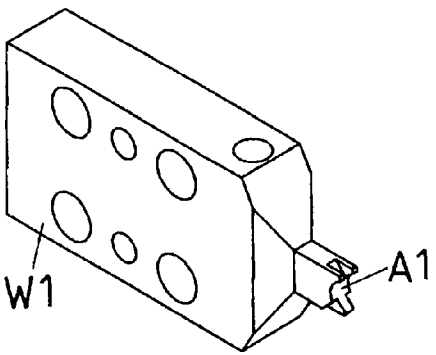
FIG. 3C is a teal part of the tool of FIGS. 3A and 3B in a perspective view.
Figure 3A:
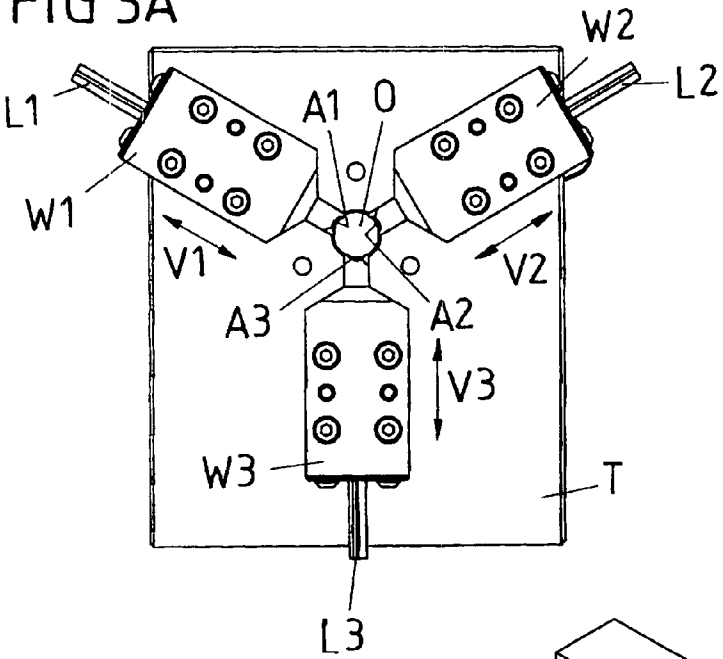
FIG. 3A is a plan view on a second embodiment of a tool to be used with the electrical cable of FIG. 1A, wherein the tool incorporates an inside-out portion of the electrical shield of a cable into the outer sheath of the cable, in a first state in which a cable to be processed can be introduced into the tool.

In FIGS. 3A through 3C, a modification of the arrangement of FIG. 2A is shown in the open state. That is, in the first state shown in FIGS. 3A through 3C, an electrical cable to be processed, specifically an (end) portion of a cable provided with an inside-out portion 25 located on the exterior of the electrical shield 2, can be introduced into the tool.

In a distinction from the arrangement of FIG. 2A, the tool shown in FIGS. 3A through 3C has three tool parts W1, W2, W3, which are movable toward one another and supported movably on a common holder T. As in the case of the arrangement shown in FIG. 2A, the tool parts W1, W2, W3 of FIGS. 3A through 3C also each have a receptacle area A1, A2 and A3. In, the open state of the tool shown in FIGS. 3A through 3C, the receptacle areas A1, A2, A3 define an opening O whose cross-section is large enough that an (end) portion of the cable, which portion is to be processed and is provided with an inside-out portion 25 located on the exterior of the electrical shield 2, can be introduced into each opening O.

An electrical line L1, L2, L3 is furthermore connected to each of the tool parts W1, W2, W3 (which are in the form of slides), to enable supplying the applicable tool part with electrical energy for operating a heating device, which makes heating of the receptacle area A1, A2, A3 of the applicable tool part W1, W2, W3 possible.

In accordance with the transition from FIGS. 3A and 3B to FIGS. 4A and 4B, the tool parts W1, W2, W3 can be shifted, in their respective movement directions V1, V2, V3, into a second, closed state. In the second closed state the receptacle areas A1, A2, A3 of the tool parts W1, W2, W3 define an opening O, whose inside diameter is less than the exterior diameter of the jacket 30 of the cable to be processed in it; see FIG. 1A. The movement directions V1, V2, V3 of the tool parts W1, W2, W3 coincide with the radial direction R of an intended electrical cable disposed in the opening O of the tool.

Figure 4B:
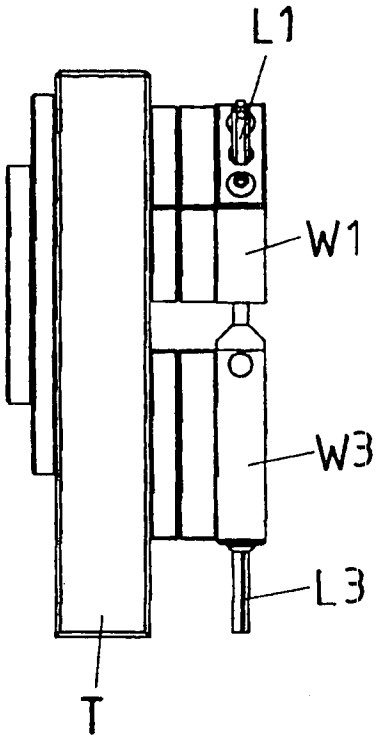
FIG. 4B is a side view of the tool of FIG. 4A.
Figure 4A:
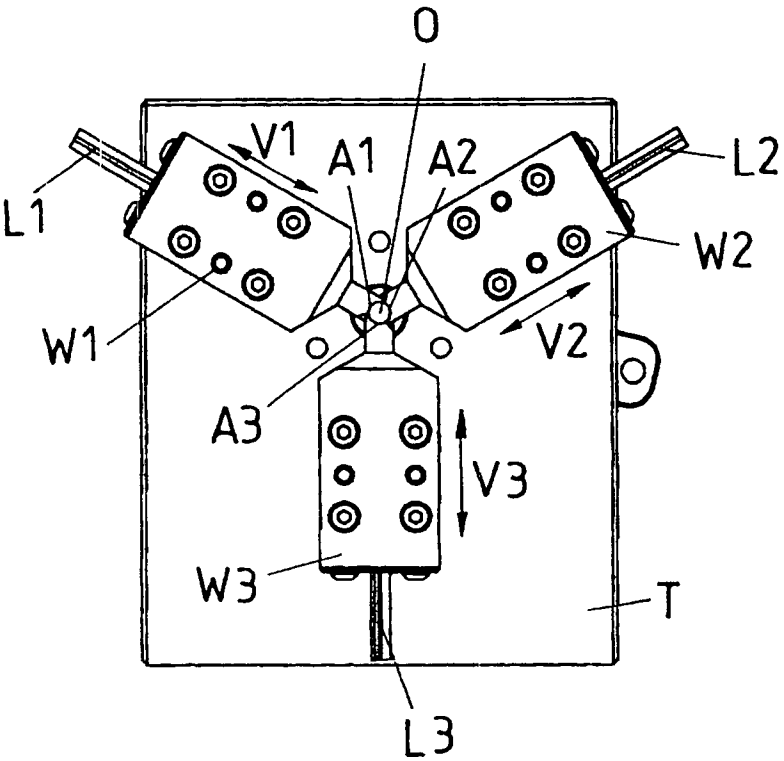
FIG. 4A is a plan view on a tool of FIG. 3A in a second state, in which an inside-out portion of the electrical shield of a cable can be incorporated into the outer sheath of the cable.

By the movement of the tool parts W1, W2, W3 into the second, closed position shown in FIGS. 4A and 4B, with simultaneous heating of the receptacle areas A1, A2, A3 of the tool parts, the jacket 30 of the electrical cable positioned in the opening O of the tool, becomes molten. Simultaneously, the portion 25*b*, extending on the exterior 31 of the jacket 30, of the portion 25 of the electrical shield 2 is incorporated or pressed into the molten portion of the jacket 30.

The tool parts W1, W2, W3 then dwell for a sufficient time in the closed position shown in FIGS. 4A and 4B to ensure a circular-annular outer contour of the previously molten portion of the jacket 30 and to keep the portion 25*b*, pressed into the jacket 30, of the inside-out portion 25 of the electrical shield 2 inside the wall defined by the jacket 30.

When after a certain dwell time of the tool in the closed state shown in FIGS. 4A and 4B is reached, the material of the jacket 30 has cooled down sufficiently so that the tool is opened in that the tool parts W1, W2, W3 are shifted back into the open position shown in FIGS. 3A and 3B. The dwell time of the tool parts W1, W2, W3 in the closed state can, on the one hand, be adjustable from the very outset and then predeterminable, or alternatively, they can be fixed only during the machining itself, as a function of a temperature measurement at the jacket 30 of the electrical conductor to be processed.

In summary, the above-described methods for manufacturing an electrical cable and the devices for performing this method are distinguished in particular by the following features:

The electrical cable to be processed is positioned with an (end) portion in which it is provided with an inside-out portion of its electrical shield in an opening, intended for it, in a tool that includes tool parts that are movable relative to one another.

By moving the tool parts toward one another, the cross-section of the opening is reduced; first, the stranded wires of the inside-out portion of the electrical shield are collected and positioned on the exterior of the jacket of the conductor to be processed.

At the same time, the tool parts are heated, so that when the tool parts meet the jacket of the conductor to be processed, melting of the jacket takes place, and the jacket changes to a viscous state. This enables the inside-out outer portion of the electrical shield to be pressed into the jacket, so that that particular portion of the electrical shield, or the stranded wires of a mesh shield that form this portion, extend inside the jacket.

The tool parts are next kept in the closed position for a certain length of time, in order to force the portion, converted to a viscous molten area, of the jacket of the electrical conductor to be processed to assume a defined shape, and in order to keep the stranded wires of the mesh shield that have been pressed into the jacket inside the jacket. (Optionally, the tool, before the step of shaping the viscous jacket, can first be opened again slightly, depending on the exterior diameter that the cable in the previously molten portion is intended to have.)

After adequate cooling down of the jacket, the tool is opened again by movement of the tool parts, and the cable can be removed.

Further embodiment variations of the method and devices in accordance with the present invention of course exist besides the explained examples and embodiments.

I claim:

1. An electrical cable comprising:

an inner conductor arrangement comprising a longitudinally extended conductor;

an outer sheath that surrounds said inner conductor arrangement annularly in cross-section, wherein said outer sheath comprises an elastically or flexibly embodied jacket that surrounds said inner conductor arrangement annularly in cross-section; and an electrical shield that extends between said inner conductor arrangement and said outer sheath, wherein said electrical shield is formed by a mesh comprising electrically conductive stranded wires; and wherein said outer sheath also surrounds a main area of said electrical shield annularly in cross-section, and a portion of said electrical shield is turned inside out in such a way that it is spaced apart from said main area of said electrical shield and defines an inside-out portion, said inside-out portion extends between said inner conductor arrangement and said outer sheath transversely to a direction in which said electrical cable extends; and wherein an exterior region of said inside-out portion of said electrical shield is incorporated into at least some portions of said outer sheath of said electrical cable so those of said electrically conductive stranded wires that form a free end of said electrical shield extend inside a wall formed by said jacket.

2. The electrical cable as defined by claim 1, wherein said exterior region of said inside-out portion is incorporated into said sheath of said electrical cable in such a way that said exterior region of said inside-out portion is pressed into a molten portion of said sheath.

3. The electrical cable as defined by claim 1, wherein an end portion of said electrical cable comprises a dimensionally stable support sleeve that adjoins said jacket in a direction in which said electrical cable extends; and wherein said outer, inside-out portion of said electrical shield extends with a first portion on an exterior of said support sleeve that is remote from said inner conductor arrangement and with a second portion of said outer, inside-out portion extending inside said jacket, wherein said second portion of said outer, inside-out portion comprises said those of said electrically conductive stranded wires that form said free end of said electrical shield.

4. The electrical cable as defined by claim 3, wherein said second portion of said outer, inside-out portion is incorporated into said jacket.

5. The electrical cable as defined by claim 1, wherein said portion of said electrical shield is incorporated into said outer sheath of said electrical cable only so far that said portion of said electrical shield does not protrude in a direction of an interior of said longitudinally extended conductor past an inside of said outer sheath of said electrical cable oriented toward said inner conductor arrangement.

6. The electrical cable as defined by claim 1, wherein said electrical shield is integrally formed with said wall formed by said jacket.

* * * * *

UNITED STATES PATENT AND TRADEMARK OFFICE

CERTIFICATE OF CORRECTION

PATENT NO. : 8,609,989 B2
APPLICATION NO. : 12/990286
DATED : December 17, 2013
INVENTOR(S) : Martin Huber It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 274 days.

Signed and Sealed this
Twenty-second Day of September, 2015

Michelle K. Lee

Michelle K. Lee
*Director of the United States Patent and Trademark Office*